US005369972A

United States Patent [19]

Kajiwara et al.

[11] Patent Number: 5,369,972

[45] Date of Patent: Dec. 6, 1994

[54] INTERSTAGE CASING FOR A PUMP MADE OF SHEET METAL AND METHOD OF MANUFACTURING THE SAME

[75] Inventors: Ken-ichi Kajiwara; Sou Kuroiwa; Kikuichi Mori; Hideo Ikeda, all of Tokyo, Japan

[73] Assignee: Ebara Corporation, Tokyo, Japan

[21] Appl. No.: 112,659

[22] Filed: Aug. 27, 1993

Related U.S. Application Data

[62] Division of Ser. No. 811,069, Dec. 20, 1991, Pat. No. 5,318,403.

[30] Foreign Application Priority Data

Dec. 25, 1990 [JP] Japan ..... 2-405847

[51] Int. Cl.[5] ..... B21D 22/26

[52] U.S. Cl. ..... 72/348

[58] Field of Search ..... 72/348, 379.4

[56] References Cited

U.S. PATENT DOCUMENTS 2,754,785 7/1956 Zatko ..... 72/348
4,877,372 10/1989 Jensen et al. .
5,040,947 8/1991 Kajiwara et al. .

FOREIGN PATENT DOCUMENTS 369515 1/1993 Austria .
557444 5/1958 Canada .
0055426 7/1982 European Pat. Off. .
3729673 3/1989 Germany .
3816280 11/1989 Germany .
54-81509 6/1979 Japan .
62-291495 12/1987 Japan .
63-170593 7/1988 Japan .
175027 7/1990 Japan ..... 72/348

*Primary Examiner*—Lowell A. Larson
*Attorney, Agent, or Firm*—Wenderoth, Lind & Ponack

[57] ABSTRACT

An interstage casing made of sheet metal includes a cylindrical receptacle-like body having a casing end wall on an end thereof and an open end opposite to The end. The omen end has an axial end surface and a radially inner surface which serve as a member of a spigot joint to be joined to the next interstage casing. The cylindrical receptacle-like body also includes a cylindrical side wall, a cylindrical portion joined between the casing end wall and the cylindrical side wall and having an outside diameter slightly smaller than an inside diameter of the open end, and a flat portion joined to the recessed portion and serving as an end surface of the casing end wall. The flat portion is adapted to be engageable with the end surface of the open end of an adjacent interstage casing. The flat portion has an outside diameter slightly larger than an outside diameter of the open end. The interstage casing further includes a recessed portion joined to The cylindrical portion and smaller in diameter than the cylindrical portion. The recessed portion provides a space for installing an O-ring therein.

15 Claims, 5 Drawing Sheets

FIG. 6 - PRIOR ART
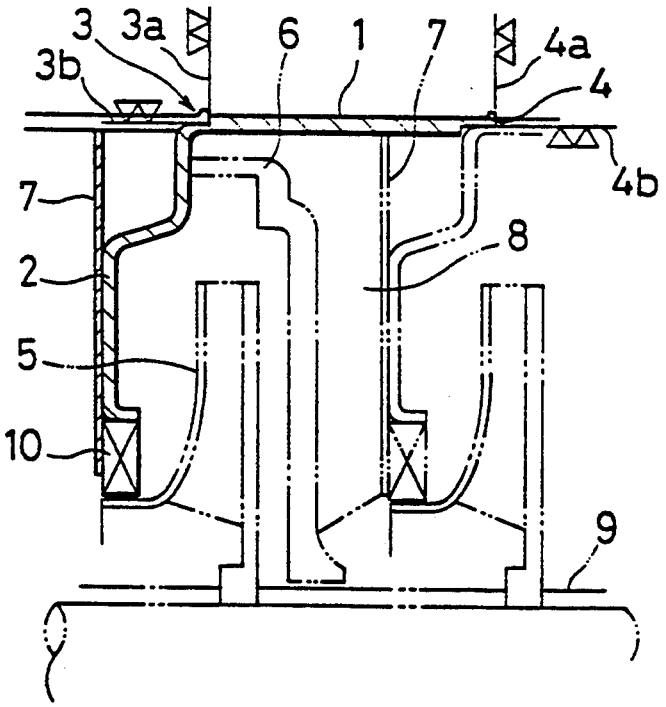

FIG. 7 - PRIOR ART
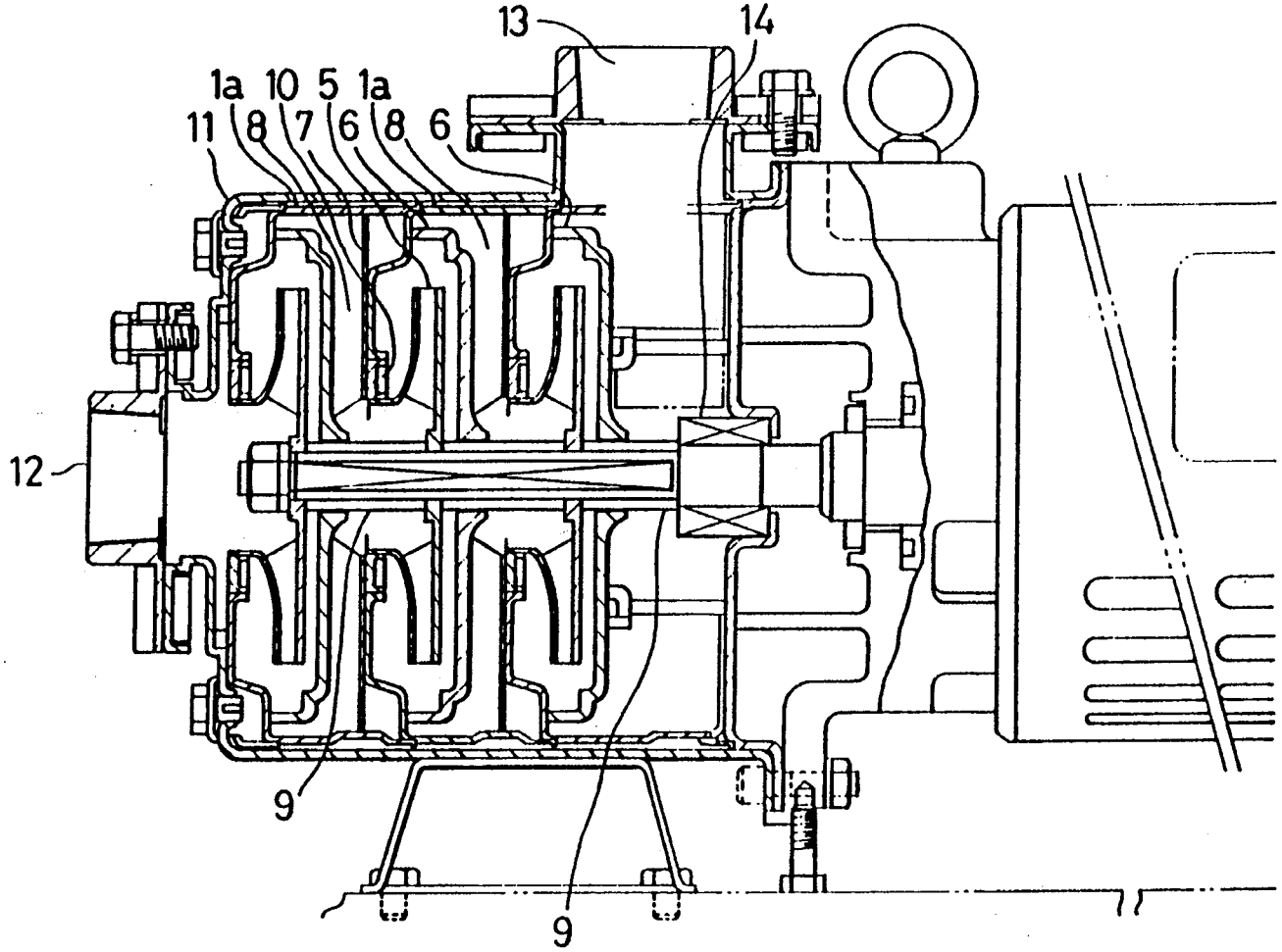

INTERSTAGE CASING FOR A PUMP MADE OF SHEET METAL AND METHOD OF MANUFACTURING THE SAME

This is a divisional application of Ser. No. 07/811,069, filed Dec. 20, 1991, now U.S. Pat. No. 5,318,403, granted Jun. 7, 1994.

BACKGROUND OF THE INVENTION

The present invention relates to a sheet metal interstage casing for a pump and a method of manufacturing the same, and more particularly to a sheet metal interstage casing pressed into shape for use in a multistage centrifugal pump and to a method of manufacturing the above interstage casing.

Conventionally, there is known a sheet metal interstage casing for a pump wherein the casing is formed of sheet metal such as a stainless steel and is manufactured by press work. This type of interstage casing is shown in FIG. 6 of the accompanying drawings. As shown in FIG. 6, the interstage casing is of a cylindrical receptacle-like structure comprising a cylindrical side wall 1 and a bottom wall (or casing end wall) 2 on an end thereof (the lefthand side in FIG. 6) which is connected to a preceding interstage casing. The opposite axial end surfaces, denoted at 3*a* and 4*a*, respectively, of the cylindrical receptacle-like structure are formed by machining a bottom end 3 and an open end 4 perpendicularly to the axis of the interstage casing. The bottom end 3 has a radially outer surface 3*b*, and the open end 4 has a radially inner surface 4*b*. The radially outer and inner surfaces 3*b*, 4*b* of adjacent interstage casings are machined so that they fit one over the other and form a spigot joint. The desired dimensional accuracy of the axial ends 3*a*, 4*a* and the spigot joint surfaces 3*b*, 4*b* is maintained by the machining process described above.

The interstage casing houses a guide vane 6 surrounding an impeller 5. The interstage casing has a return passage 8 defined laterally of the guide vane 6 and between the guide vane 6 and a guide vane side wall 7 that is welded to the cylindrical receptacle-like structure of a next adjacent interstage casing. The interstage casing also accommodates a shaft 9 on which the impeller 5 is mounted. A liner ring 10 is attached to the bottom wall 2 and positioned between the inner circumferential surface thereof and the impeller 5.

FIG. 7 of the accompanying drawings shows in fragmentary cross section a vertical-shaft multistage centrifugal pump comprising interstage casings each have the structure shown in FIG. 6. The interstage casings, each denoted at 1*a* in FIG. 7, are assembled within an outer casing 11 having a suction port 12 and a discharge port 13. The shaft 9 is rotatably supported in the outer casing 11 through a shaft seal device 14.

When the multistage centrifugal pump is in operation, the liquid to be pumped is drawn from the suction port 12 and pressurized by the successive impellers 5 in the interstage casings 1*a*. The pressure head of the liquid is restored as the liquid passes through each of the guide vanes 6 and the return passages 8. Finally,.the liquid is discharged out of the pump through the discharge port 13.

The interstage casing of pressed sheet metal shown in FIG. 6 maintains a desired degree of dimensional accuracy for diameters and heights through the machining of the four regions, i.e., the radially outer surface 3*b* and the axial end surface 3*a* of the male member of a spigot joint on the bottom end 3, and the radially inner surface 4*b* and the axial end surface 4*a* of the female member of a spigot joint on the open end 4. The dimensional accuracy of these machined structures is considerably lower than that of casted structures because the wall thickness of the interstage casing structure is small. When the machined casing structure is removed from a machine tool, the cylindrical shape thereof tends to be deformed into an elliptical shape with a dimensional error ranging from 0.3 to 0.5 mm. Since the machined regions are reduced in thickness, it is necessary that the interstage casing blank be thick enough to provide desired mechanical strength.

Sealing between the interstage casings is achieved by liquid gaskets that are of relatively low reliability since no installation space is available between the interstage casings for O-rings that are widely used in pump casings made by casting. Consequently, the interstage casings with liquid gaskets are not suitable for use in applications that require the development of very high pressures or environments that should be kept free from the leakage of the liquid from the pump.

SUMMARY OF THE INVENTION

It is therefore-an object of the present invention to provide an interstage casing for a pump, made of sheet metal pressed to shape, which is free from machining processes that would otherwise be necessary to produce highly accurate regions, and hence from mechanical failures and dimensional errors that would otherwise possibly result from such machining processes, and which allows general O-ring to be used as seals between the stages of the pump.

Another object of the present invention is to provide a method of manufacturing an interstage casing for a pump which can reduce the total number of steps to manufacture the interstage casing.

To achieve the above object, there is provided in accordance with one aspect of the present invention a sheet metal interstage casing for a pump, comprising: a cylindrical side wall having an open end on an end thereof, the open end having an axial end surface and a radially inner surface serving as a female member of a spigot joint; a bottom wall (or casing end wall) perpendicular to the cylindrical side wall; a cylindrical portion provided between the bottom wall and the cylindrical side wall and having an outside diameter slightly smaller than an inside diameter of the open end of the cylindrical side wall; and a flat portion provided between the cylindrical portion and the cylindrical side wall so as to be engageable with the end surface of the open end of an adjacent interstage casing, the flat portion having an outside diameter slightly larger than an outside diameter of the open end.

According to another aspect of the present invention, there is provided a-method of manufacturing a sheet metal interstage casing for a pump, comprising the steps of: forming a first pressed blank in the form of a cylindrical receptacle having a bottom wall (or casing end wall), a first cylindrical portion joined to the bottom wall, and a second cylindrical portion having an outside diameter slightly larger than the outside diameter of the first cylindrical portion; and axially pressing the first pressed blank finally into an interstage casing while confining an end surface of an open end of the second cylindrical portion and radially inner and outer surfaces of the second cylindrical portion which extend from the end surface to a region near the first cylindrical portion and also confining a radially inner surface of the first cylindrical portion.

The cylindrical portion is integrally joined to the bottom wall and disposed between the bottom wall and the cylindrical side wall, the cylindrical portion having a radially outer surface serving as the male member of a spigot joint. The cylindrical side wall has the radially inner surface serving as the female member of a spigot joint. The flat portion is integrally joined to the cylindrical portion through the recessed portion. When the radially inner surface is fitted over the radially outer surface of the cylindrical portion, the end surface of the open end of the adjacent interstage casing is held against the flat portion. The radially inner surface of the open end, the radially outer surface of the cylindrical portion, the flat portion, and the end surface of the open end are accurately pressed by-a die assembly depending on the accuracy of the die assembly. The interstage casing is not subject to errors which would otherwise occur due to a machining process.

The interstage casing further comprises a recessed portion provided between the cylindrical portion and the cylindrical side wall, the recessed portion being smaller in diameter than the cylindrical portion. An O-ring can be mounted on the recessed portion, therefore, the interstage casing can employ an O-ring which is most commonly used as an interstage seal in multistage pumps. Consequently, the interstage casing of pressed sheet metal is widely applicable to high-pressure pumps.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 6 is a fragmentary cross-sectional view of a conventional interstage casing; and FIG. 7 is a longitudinal cross-sectional view of a multistage centrifugal pump with the conventional interstage casings.

DETAILED DESCRIPTION OF THE PREFERRED EMBODIMENTS

A sheet metal interstage casing for a pump according to an embodiment of the present invention will be described with reference to FIGS. 1 through 4.

Figure 1:
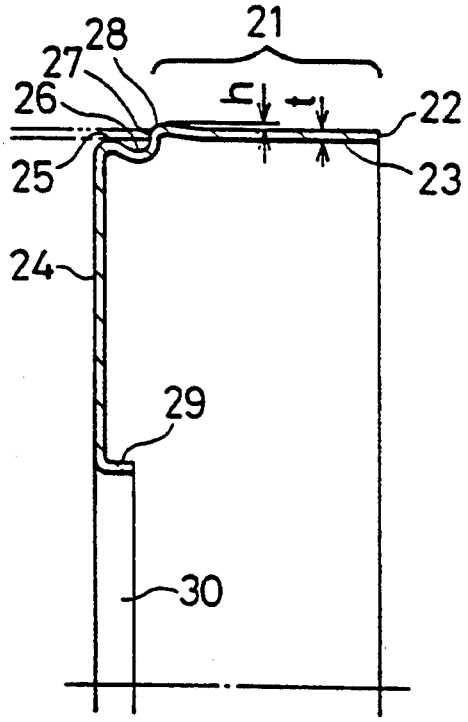
FIG. 1 is a fragmentary cross-sectional view of an upper half of an interstage casing according to an embodiment of the present invention.

FIG. 1 shows in fragmentary cross section an upper half of an interstage casing according to an embodiment of the present invention. The interstage casing is used particularly in a multistage centrifugal pump.

As shown in FIG. 1, an interstage casing is in the form of a deformed cylindrical receptacle-like body comprising a cylindrical side wall 21 having a wall thickness t. The cylindrical side wall 21 has on an open end thereof an axial end surface 22 and a radially inner surface 23 as the female member of a spigot joint. The cylindrical receptacle-like body also includes a bottom wall (or casing end wall) 24 opposite to the open end. Between the cylindrical side wall 21 and the bottom wall 24, there are provided a cylindrical portion 25 joined to the bottom wall 24 and having an outside diameter that is substantially equal to or slightly smaller than the inside diameter of the open end, and a recessed portion 26 integrally joined to the cylindrical portion 25 and having a diameter smaller than that of the cylindrical portion 25. The cylindrical portion 25 serves as the male member of a spigot joint. The recessed portion 26 is joined to a flat portion 27 serving as a bottom wall end surface and integrally joined to the cylindrical side wall 21 through a protruding portion 28 that projects radially outwardly from the outer surface of the cylindrical side wall 21. The protruding portion 28 has an inside diameter smaller than the outside diameter of the open end of the cylindrical side wall 21. The protruding portion 28 has an outside diameter larger than the outside diameter of the open end of the cylindrical side wall 21, thus providing support for the axial end surface 22 of the cylindrical side wall of an adjacent interstage casing. The difference $2h$ between the outside diameter of the protruding portion 28 and the outside diameter of the cylindrical side wall 21 at the open end thereof is selected to be equal to or less than twice the wall thickness t. As described later on, the protruding portion 28 has an inside diameter smaller than the outside diameter of the open end of the cylindrical side wall 21. The bottom wall 24 has a radially inner flange 29 for supporting a liner ring (not shown), the radially inner flange 29 defining a fluid passage 30 radially inwardly thereof.

Figure 2:
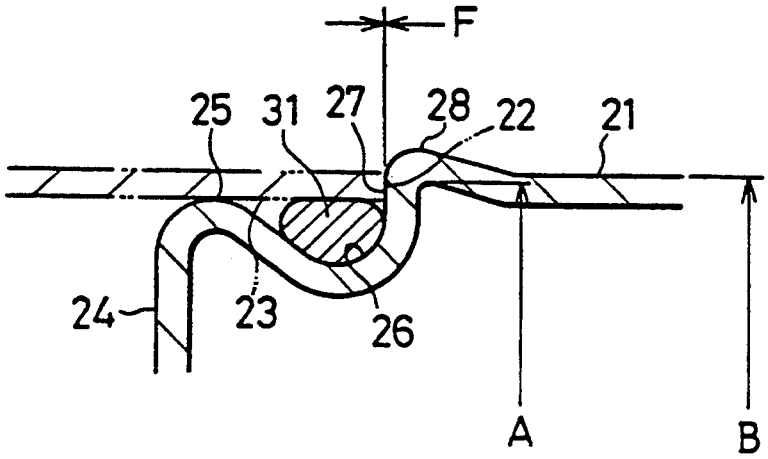
FIG. 2 is an enlarged fragmentary cross-sectional view showing the manner in which adjacent interstage casings according to the present invention fit one over the other.

FIG. 2 fragmentarily shows the interstage casing shown in FIG. 1 which is fitted in an adjacent interstage casing. The axial end surface 22 of the open end of the adjacent interstage casing is held in abutment against the flat portion 27 as the bottom wall end surface of the interstage casing. The radially inner surface 23 of the open end of the adjacent interstage casing is fitted over the cylindrical portion 25 joined to the bottom wall 24 of the interstage casing, with an O-ring 31 mounted on the recessed portion 26. The flat portion 27 extends perpendicularly to the cylindrical side wall 21. The axial end surface 22 has a full or substantially full surface area that engages the flat portion 27. Incidentally, the flat portion 27 may be inclined with respect to the cylindrical side wall 21 at certain angle so long as the contacting area of the flat portion 27 and the axial end surface 22 is secured.

The radially inner surface 23 and the cylindrical portion 25, which are fitted together as a spigot joint, and the axial end surface 22 and the flat portion 27 that abut against each other are fabricated by molds with their dimensional accuracy achieved by the dimensional accuracy of the molds themselves. The interstage casing may be formed by bulging, which is one of the press forming processes.

As shown in FIG. 2, since the inside diameter A of the protruding portion 28 is smaller than the outside diameter B of the open end of the cylindrical side wall 21, when the adjacent interstage casings are joined to each other, axial forces and internal pressure are developed to produce an axial force F which is applied as a compressive stress, but not as a bending stress, to the protruding portion 28. If the outside diameter B were smaller than the inside diameter A, then the protruding portion 28 would be subject to a bending stress, making it necessary to give certain mechanical strength to the local region to which the bending stress would be applied. Inasmuch as the inside diameter A of the protruding portion 28 affects the flat portion 27 as the bottom wall end surface, it is necessary that the flat portion 27 provide a sufficient flat area. The radially outward projection of the protruding portion 28 may not necessarily be required if the flat portion 27 provides a sufficient flat area.

Figure 3:
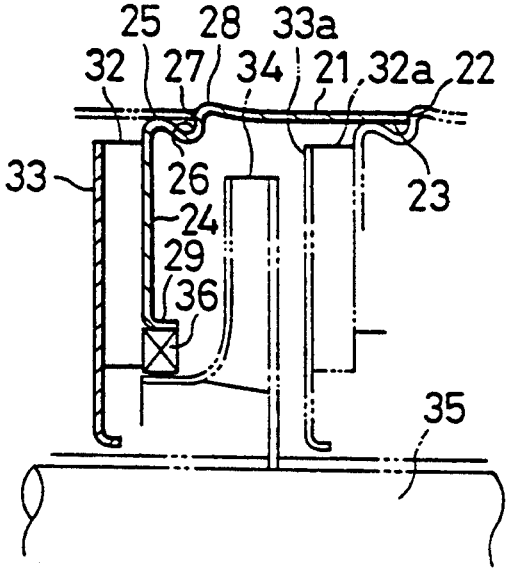
FIG. 3 is a fragmentary cross-sectional view of the upper half of the interstage casing with a return blade attached thereto according to the present invention.

FIG. 3 shows the upper half of the interstage casing shown in FIG. 1 with a return blade attached thereto.

Figure 4:
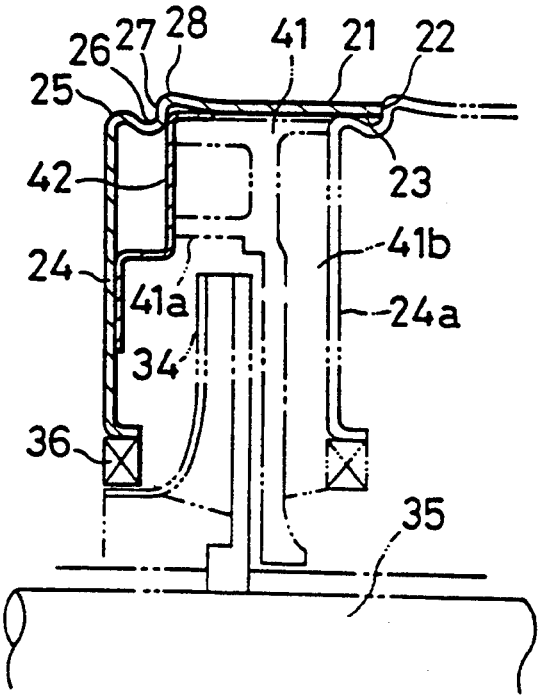
FIG. 4 is a fragmentary cross-sectional view of the upper half of the interstage casing with a guide vane housed therein according to the present invention.

As shown in FIG. 4, a return blade 32 is welded to the outer surface of the bottom wall 24 of the interstage casing. A side plate 33 is attached to a lateral end of the return blade 32 so that the return blade 32 is sandwiched between the side plate 33 and the bottom wall 24. An impeller 34 is mounted on a shaft 35 and housed in the interstage casing. A liner ring 36 is attached to the radially inner surface of the flange 29 in surrounding relation to an inlet of The impeller 34.

During operation of the pump, the liquid discharged out of the impeller in the preceding interstage casing (on the lefthand side as shown) flows through a passage defined by the return blade 32 sandwiched between the bottom wall 24 and the side plate 33, and is introduced into The inlet of the impeller 34 of the next stage. After the liquid is discharged under pressure by the impeller 34, the liquid is directed to the next impeller through a passage that is defined by a return blade 32 of the next interstage casing (on the righthand side as shown). The liner ring 36 around the inlet of the impeller 34 is attached to the flange 29 of the bottom wall 24 for preventing the liquid from leaking out under pressure.

FIG. 4 shows the upper half of the interstage casing shown in FIG. 1 with a guide vane 41 housed therein.

As shown in FIG. 4, a guide vane 41 is disposed around the impeller 34. A side plate 42 is attached to a side (facing the preceding interstage casing) of the guide vane 41, defining a passage 41*a* for restoring the pressure of the liquid to be pumped. A return passage 41*b* is defined between the guide vane 41 and the bottom wall 24*a* of the next interstage casing, the return passage 41*b* communicating with the passage 41*a*.

When the pump is in operation, the guide vane 41 collects the liquid discharged from the impeller 34, and the liquid is sent to the next interstage casing through the passage 41*a* which restores the pressure of the liquid and the return passage 41*b* communicating therewith.

A process of manufacturing the interstage casing shown in FIG. 1 will be described below with reference to FIG. 5.

A sheet metal such as a steel plate is blanked into a circular blank, which is pressed into a first pressed blank in the form of a cylindrical receptacle having a first cylindrical portion joined to a bottom wall (or end wall) and a second cylindrical portion joined to the first cylindrical portion and having an outside diameter slightly larger than the outside diameter of the first cylindrical portion.

Figure 5A:
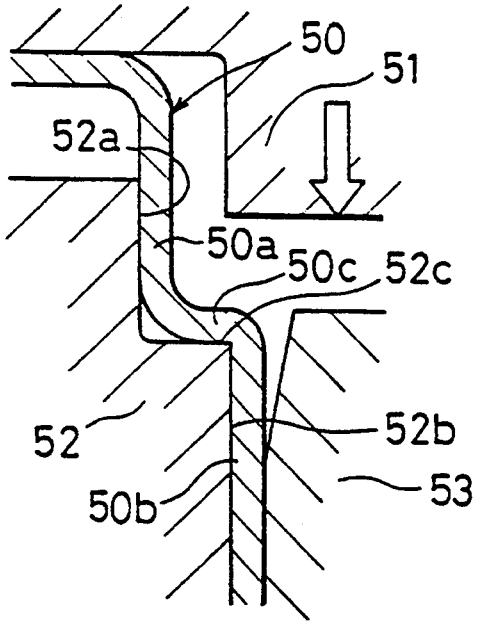
FIGS. 5(*a*), 5(*b*), and 5(*c*) are enlarged cross-sectional view showing a process of manufacturing the interstage casing according to the present invention.
Figure 5B:
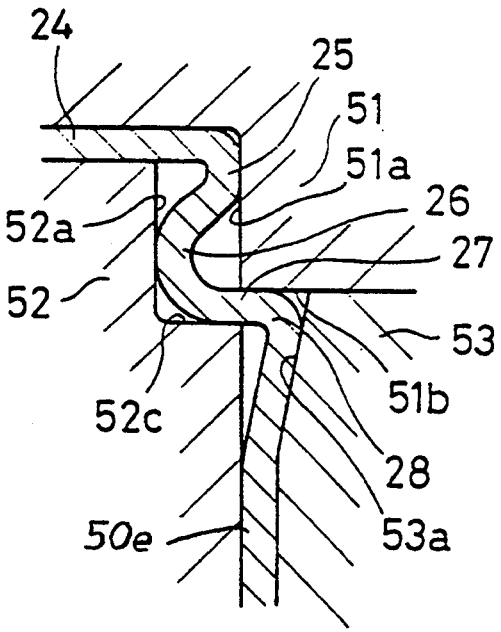
Figure 5C:
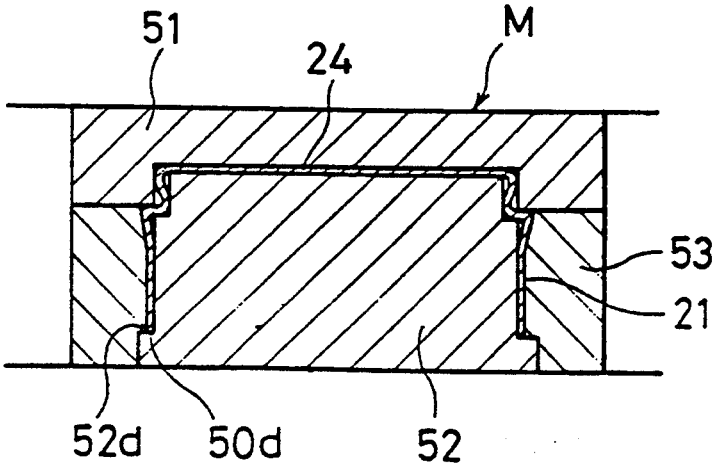

Then, the first pressed blank is pressed to a final shape using a die assembly M as shown in FIGS. 5(*a*) through 5(*c*). As shown in FIG. 5(*c*), the die assembly M comprises an upper die 51, a radially inner lower die 52, and a radially outer lower die 53.

FIG. 5(*a*) shows the first pressed blank, denoted at 50, placed in the die assembly M before being finally shaped. With the first pressed blank 50 placed in the die assembly M, the first cylindrical portion, denoted at 50*a*, is fitted over a smaller-diameter portion 52*a* of the radially inner lower die 52, and the second cylindrical portion, denoted at 50*b*, is fitted over a larger-diameter portion 52*b* of the radially inner lower die 52. At the same time, an intermediate step 50*c* by which the first and second cylindrical portions 50*a*, 50*b* are joined engages with a first step 52*c* of the radially inner lower die 52. As shown in FIG. 5(*c*), the second cylindrical portion 50*b* has a lower end 50*d* (with a free end surface) held in abutment against a second step 52*d* of the radially inner lower die 52, and a portion 50*e* of the second cylindrical portion 50*b* extending from the free end surface 50*d* toward the first cylindrical portion 50*a* is rigidly confined to prevent it from being deformed radially.

Then, the upper die 51 is moved downwardly from the position shown in FIG. 5(*a*) toward the lower ties 52, 53. The first pressed blank 50 is axially or vertically pressed into a shape as shown in FIG. 5(*b*). In FIG. 5(*b*), the first cylindrical portion 50*a* is formed with the cylindrical portion 25 and the recessed portion 26 smaller in diameter than the cylindrical portion 25, and the intermediate step 50*c* is formed with the flat portion 27 joined to the recessed portion 26. At this time, the outside diameter of the cylindrical portion 25 is forcibly set to a predetermined dimension by an inner circumferential surface 51*a* of the upper die 51, and the inside diameter of the recessed portion 26 is forcibly set to a predetermined dimension by the smaller-diameter portion 52*a* of the radially inner lower die 52. The flat portion 27 is also forcibly set to a predetermined degree of flatness by an end surface 51*b* of the upper die 51 and the first step 52*c* of the radially inner lower die 52. The second cylindrical portion 50*b* is formed with the protruding portion 28 contiguous to the flat portion 27 and projecting radially outwardly. The outside diameter of the protruding portion 28 is forcibly set to a predetermined dimension by a tapered inner circumferential surface 53*a* of the radially outer lower die 53.

The interstage casing according to the present invention offers the following advantages:

Since the interstage casing is not machined, it is not deformed or subjected to dimensional errors by forces that would be applied if the steel sheet were fastened for machining, and by stresses and heat that would be developed if the steel sheet were machined. The desired dimensional accuracy of certain regions of the interstage casing can be achieved by the dimensional accuracy of the die assembly used.

The total number of steps required to fabricate the interstage casing is reduced because the machining process, which is entirely different from the press forming process, is eliminated.

Inasmuch as the regions of the conventional interstage casing which are subject to greatest loads are machined, the other regions tend to have a larger thickness so that those regions under the greatest loads have a sufficient thickness. According to the present invention, however, the interstage casing may be uniform in thickness, have a relatively small weight, and be reduced in cost.

An O-ring may be mounted on the recessed portion that is smaller in diameter than the cylindrical portion joined to the bottom wall and serving as the male member of a spigot joint. Therefore, the interstage casing, which is formed of pressed sheet metal, can be used in environments that should be free from liquid leakage and in pumps that develop relatively high pressures.

Although a certain preferred embodiment of the present invention has been shown and described in detail, it should be understood that various changes and modifications may be made therein without departing from the scope of the appended claims.

What is claimed is:

1. A method of manufacturing a sheet metal interstage casing for a pump, comprising:

forming a first pressed blank into a cylindrical receptacle having a casing end wall, a first cylindrical portion joined to and extending from said casing end wall, and a second cylindrical portion joined to and extending from said first cylindrical portion, said second cylindrical portion having an outside diameter larger than an outside diameter of said first cylindrical portion and having a free end surface remote from said first cylindrical portion; and axially pressing said first pressed blank while confining said free end surface of said second cylindrical portion, while rigidly confining a first portion of said second cylindrical portion extending from said free end surface thereof and toward said first cylindrical portion such that said first portion is prevented from being deformed radially, and while confining an inner circumferential surface of said first cylindrical portion, so as to form said first pressed blank into a final shape of said interstage casing.

2. A method of manufacturing a sheet metal interstage casing as recited in claim 1, wherein in axially pressing said first pressed blank so as to form said first pressed blank into the final shape of said interstage casing, said first pressed blank is placed in a mold assembly including an inner die, and first and second outer dies.

3. A method of manufacturing a sheet metal interstage casing as recited in claim 2, wherein in placing said first pressed blank in said mold assembly, said casing end wall is interposed between said inner die and said first outer die, and said second cylindrical portion is interposed between said inner die and said second outer die.

4. A method of manufacturing a sheet metal interstage casing as recited in claim 3, wherein in placing said first pressed blank in said mold assembly, said first cylindrical portion is interposed between said inner die and said first outer die.

5. A method of manufacturing a sheet metal interstage casing as recited in claim 1, wherein in axially pressing said first pressed blank so as to form said first pressed blank into the final shape of said interstage casing, said first pressed blank is placed in a mold assembly including an inner die having a first circumferential stepped portion and a second circumferential stepped portion, and first and second outer dies.

6. A method of manufacturing a sheet metal interstage casing as recited in claim 5, wherein in forming said first pressed blank, an annular flat portion is formed at a junction between said first cylindrical portion and said second cylindrical portion; and in placing said first pressed blank in said mold assembly, said end surface of said second cylindrical portion is supported on said first circumferential stepped portion, and said annular flat portion is supported on said second circumferential stepped portion.

7. A method of manufacturing a sheet metal interstage casing as recited in claim 6, wherein said second outer die has an annular recess formed in an inner circumference of a first end thereof for receiving said first circumferential stepped portion, and an annular tapered portion, tapered outwardly and toward said second end of said second outer die, formed in an inner circumference of a second end thereof; and in axially pressing said first pressed blank so as to form said first pressed blank into the final shape of said interstage casing, an end portion of said second cylindrical portion adjacent said annular flat portion is forced radially outwardly to conform to said annular tapered portion of said second outer die.

8. A method of manufacturing a sheet metal interstage casing as recited in claim 7, wherein in axially pressing said first pressed blank so as to form said first pressed blank into the final shape of said interstage casing, an annular portion of said first cylindrical portion is deformed to form an annular recessed portion.

9. A method of manufacturing a sheet metal interstage casing as recited in claim 1, wherein in axially pressing said first pressed blank so as to form said first pressed blank into the final shape of said interstage casing, an annular portion of said first cylindrical portion is deformed to form an annular recessed portion.

10. A method of manufacturing a sheet metal interstage casing as recited in claim 1, wherein in axially pressing said first pressed blank so as to form said first pressed blank into the final shape of said interstage casing:

said inner circumferential surface of said first cylindrical portion is rigidly confined such that it is prevented from being deformed radially inwardly; and a portion of said first cylindrical portion adjacent said casing end wall is allowed to expand radially outwardly such that said first cylindrical portion is deformed to include an annular recessed portion between said second portion of said first cylindrical portion and an end of said first cylindrical portion adjacent said second cylindrical portion.

11. A method of manufacturing a sheet metal interstage casing as recited in claim 1, wherein in axially pressing said first pressed blank into the final shape of said interstage casing, said first pressed blank is placed in a mold assembly including an inner die and an outer die in such a manner that said free end surface of said second cylindrical portion is rigidly confined in a predetermined position and remains in said predetermined position throughout axially pressing said first pressed blank into the final shape of said interstage casing.

12. A method of manufacturing a sheet metal interstage casing as recited in claim 1, wherein in axially pressing said first pressed blank into the final shape of said interstage casing, said first pressed blank is placed in a mold assembly including an inner die and at least one outer die, and an end portion of said second cylindrical portion adjacent said first cylindrical portion is forced to bulge radially outwardly and become spaced outwardly from said inner die.

13. A method of manufacturing a sheet metal interstage casing as recited in claim 1, wherein in axially pressing said first pressed blank into the final shape of said interstage casing, said first pressed blank is initially placed in a mold assembly including an inner die and at least one outer die such that said casing end wall is spaced apart from said inner die, and said casing end wall is then pressed axially such that it contacts said inner die and such that a portion of said first cylindrical portion is deformed radially.

14. A method of manufacturing a sheet metal interstage casing for a pump, comprising:

forming a first pressed blank into a cylindrical receptacle having a casing end wall, a first cylindrical portion joined to and extending from said casing end wall, and a second cylindrical portion joined to and extending from said first cylindrical portion and having an outside diameter larger than an outside diameter of said first cylindrical portion;

axially pressing said first pressed blank while confining an end surface of said second cylindrical portion remote from said first cylindrical portion, a portion of an inner circumferential surface of said second cylindrical portion extending from said end surface thereof and toward said first cylindrical portion, and an inner circumferential surface of said first cylindrical portion, so as to form said first pressed blank into a final shape of said interstage casing; and in axially pressing said first pressed blank so as to form said first pressed blank into the final shape of said interstage casing, an annular portion of said first cylindrical portion is deformed to form an annular recessed portion.

15. A method of manufacturing a sheet metal interstage casing for a pump, comprising:

forming a first pressed blank into a cylindrical receptacle having a casing end wall, a first cylindrical portion joined to and extending from said casing end wall, and a second cylindrical portion joined to and extending from said first cylindrical portion and having an outside diameter larger than an outside diameter of said first cylindrical portion;

axially pressing said first pressed blank while confining an end surface of said second cylindrical portion remote from said first cylindrical portion, a portion of an inner circumferential surface of said second cylindrical portion extending from said end surface thereof and toward said first cylindrical portion, and an inner circumferential surface of said first cylindrical portion, so as to form said first pressed blank into a final shape of said interstage casing; and in axially pressing said first pressed blank into the final shape of said interstage casing, said first pressed blank is initially placed in a mold assembly including an inner die and at least one outer die such that said casing end wall is spaced apart from said inner die, and said casing end wall is then pressed axially such that it contacts said inner die and such that a portion of said first cylindrical portion is deformed radially.

* * * * *